US009108816B2

(12) United States Patent
Sei

(10) Patent No.: US 9,108,816 B2
(45) Date of Patent: Aug. 18, 2015

(54) IMAGE FORMING APPARATUS AND IMAGE FORMING METHOD

(71) Applicants: Kabushiki Kaisha Toshiba, Tokyo (JP); Toshiba Tec Kabushiki Kaisha, Tokyo (JP)

(72) Inventor: Masaaki Sei, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/074,459

(22) Filed: Nov. 7, 2013

(65) Prior Publication Data

US 2015/0123343 A1 May 7, 2015

(51) Int. Cl.
*B65H 29/00* (2006.01)
*B65H 29/58* (2006.01)

(52) U.S. Cl.
CPC ..... *B65H 29/00* (2013.01); *B65H 29/58* (2013.01); *B65H 2551/00* (2013.01); *B65H 2551/10* (2013.01); *B65H 2551/20* (2013.01); *B65H 2801/00* (2013.01); *B65H 2801/03* (2013.01)

(58) Field of Classification Search
CPC .... B65H 29/00; B65H 29/58; B65H 2551/00; B65H 2551/10; B65H 2551/20; B65H 2801/00; B65H 2801/03
USPC ..... 271/298, 303, 213; 399/405; 347/104; 270/58.19
See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 5,548,376 | A * | 8/1996 | Kikuno | 399/19 |
| 5,644,494 | A * | 7/1997 | Richardson et al. | 700/223 |
| 2009/0295071 | A1* | 12/2009 | Takahashi et al. | 271/162 |
| 2010/0074640 | A1* | 3/2010 | Okano | 399/45 |
| 2011/0211888 | A1* | 9/2011 | Fujinaga | 399/403 |
| 2012/0242028 | A1* | 9/2012 | Ishizu | 270/58.01 |
| 2012/0286465 | A1* | 11/2012 | Ooba | 271/9.01 |

FOREIGN PATENT DOCUMENTS

JP 2005-263341 9/2005

* cited by examiner

*Primary Examiner* — David H Bollinger
(74) *Attorney, Agent, or Firm* — Patterson & Sheridan, LLP

(57) ABSTRACT

An image forming apparatus includes a printer section configured to print image data to a paper according to a print job, a control panel configured to receive instructions regarding the print job, a first discharging tray configured to receive the printed paper, and an second discharging tray configured to be opened and closed, to receive the printed paper when opened, and guide the printed paper to the first discharging tray when closed. The image forming apparatus further includes a detection section configured to detect whether the second discharging tray is open or closed, and a control section configured to control execution of the print job including controlling the printer section based on the instructions received in the control panel and the detection result of the detection section.

20 Claims, 5 Drawing Sheets

IMAGE FORMING APPARATUS AND IMAGE FORMING METHOD

FIELD

Embodiments described herein relate to an image forming apparatus such as a multi-function peripheral or a printer and an image forming method.

BACKGROUND

An image forming apparatus which is provided with an openable and closable discharge port on a conveyance path for discharging papers to an in-body tray when executing a print job, is known in the art. When the discharge port on the conveyance path is opened, papers are forcibly discharged to the discharge port even if the in-body tray is designated as a paper discharging destination.

If the in-body tray is designated as the paper discharging destination, a paper of small size, which cannot be discharged to the in-body tray because of hardware restriction, is discharged instead to the discharge port on the conveyance path.

However, there may be problems when a finisher is mounted to execute stapling operation. For example, when a paper, before being stapled, is discharged to the discharge port on the conveyance path if the discharge port is opened, or when a paper that is printed only on one side, but not on two sides, is output to the discharge port when the discharge port is opened during a double-sided printing, or when papers which can only be output to the discharge port on the conveyance path are printed, a jam may occur if the papers are forcibly output when the discharge port is closed.

DETAILED DESCRIPTION

An image forming apparatus according to an embodiment includes a printer section configured to print image data to a paper according to a print job, a control panel configured to receive instructions regarding the print job, a first discharging tray configured to receive the printed paper, and an second discharging tray configured to be opened and closed, to receive the printed paper when opened, and guide the printed paper to the first discharging tray when closed. The image forming apparatus further includes a detection section configured to detect whether the second discharging tray is open or closed, and a control section configured to control execution of the print job including controlling the printer section based on the instructions received in the control panel and the detection result of the detection section.

The embodiment is described below in detail with reference to the accompanying drawings.

An multi-function peripheral (MFP) 100 is described below as an image forming apparatus according to the embodiment. The MFP scans, reads and copies an image according to a designated resolution and a designated paper size. Further, the MFP 100 has comprehensive functions of various office machines, such as an FAX-based image receiving function, an email-based image receiving function and a network-based printed image receiving function.

Figure 1:
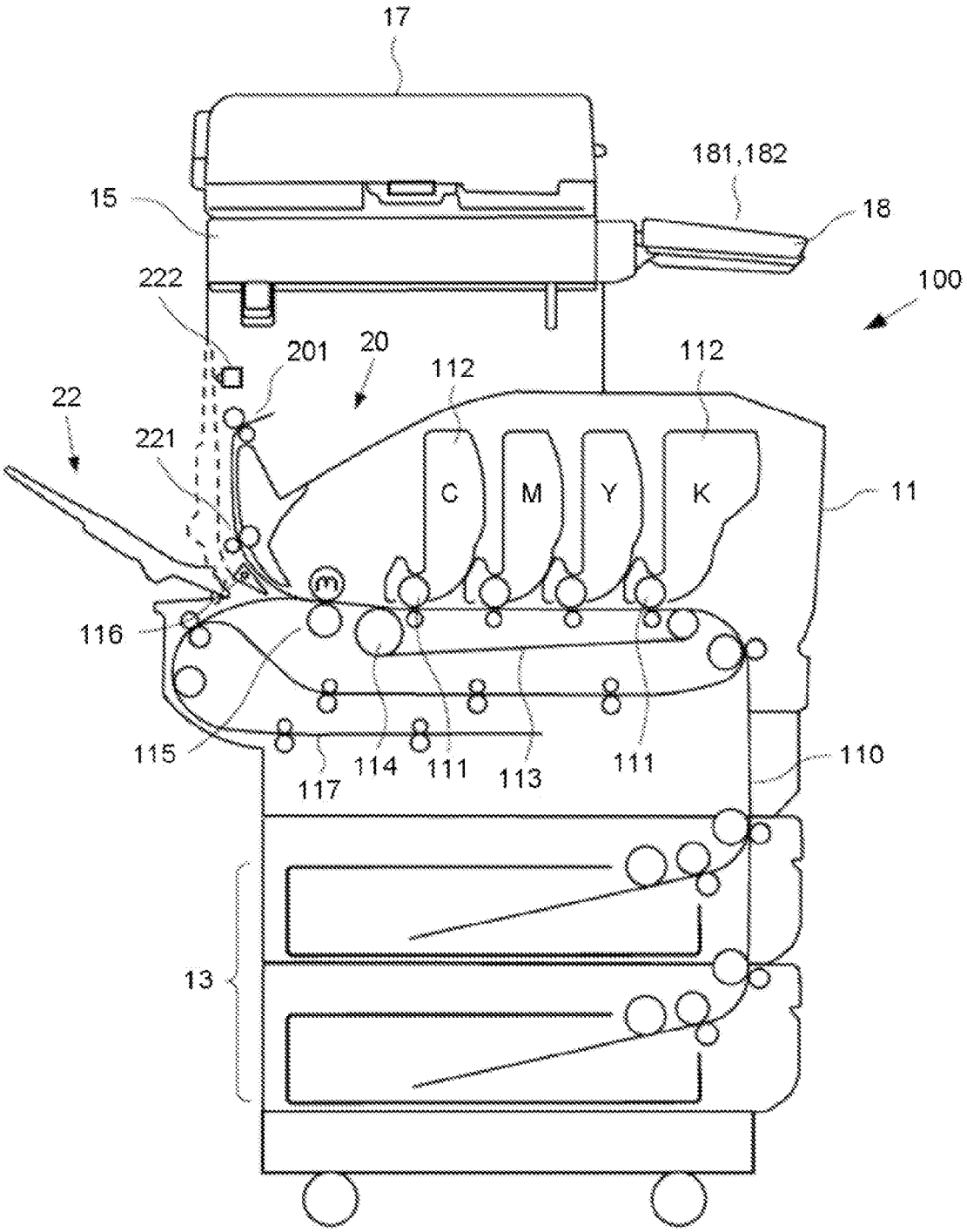
FIG. 1 is a schematic diagram illustrating a an image forming apparatus according to an embodiment.

FIG. 1 is a schematic diagram illustrating the MFP 100. A printer section 11, a paper tray 13, a scanner section 15, an ADF (Auto Document Feeder) 17 and a control panel 18 are arranged on the MFP 100.

The printer section 11 outputs image information as an output image called as, for example, 'hard copy' or 'printout'. The paper tray 13 feeds a printing object, (i.e., a paper or other sheet of various sizes used in an image output) to the printer section 11. The scanner section 15 acquires image information from a document as image data. The ADF 17 feeds the read document from a reading position to a discharging position and guides the next document to the reading position.

The control panel 18 consists of operation keys 181 and a display section 182. The operation keys 181 allows a user to input various operations of the MFP 100, such as the start of image formation by the printer section 11 and the document image information reading by the scanner section 15. The display section 182 may be an LCD (Liquid Crystal Display) and also accepts inputs of operations. The display section 182 also displays information for the operator.

The MFP 100 comprises an in-body first discharging tray 20 and an external second discharging tray 22. In the first discharging tray 20, a printing object such as a paper bundle is discharged from the first discharge port 201 after being stapled by a staple unit (not shown). A printing object that is a paper subject to double-sided printing (i.e., printing on both sides) is also discharged to the first discharging tray 20, face up. Also, a printing object such as a paper is discharged to the first discharging tray 20 when the second discharging tray 22 is closed. In addition to a stapled paper bundle and a double-sided-printed paper, a paper printed on one side may also be discharged to the first discharging tray 20. Printing objects are discharged to the second discharging tray 22 with the face down. Whether or not the first discharging tray 20 is opened is detected by a gate switch 222, which may be an optical switch, an electronic switch or a mechanical switch.

Further, the second discharging tray 22 also functions as a gate which can be opened or closed freely. When opened, the second discharging tray 22 functions as a tray. The second discharging tray 22 directly discharges a printing object from a second discharge port 221. The second discharging tray 22 may discharge a printing object which is jammed during attempted discharge to the first discharge port 201.

Further, the MFP 100 can be connected with a network (not shown) or a communication line (not shown) to receive image data by means of FAX and/or email.

The reading operation carried out mainly by the scanner section 15 is described first.

When a document is placed on the ADF 17, a document existence sensor (not shown) detects whether or not there is a document. When a document is detected, the paper feed roller and the conveyance belt in the ADF 17 rotate to convey the document to a specific position on a document table. Then, the scanner section 15 reads an image on the document as the image data and stores the image data in a memory in control section 30.

After the reading is ended, the conveyance belt in the ADF 17 rotates again to convey the document, and the document is discharged to a document discharging tray (not shown) by a conveyance roller for paper discharging. If there are a plurality of documents, a document is conveyed from the document table to the right side in FIG. 1 to be discharged. Meanwhile, the next document is continuously fed from the left side in FIG. 1 to be read.

The printing operation carried out mainly by the printer section 11 is now described.

Print image data is temporarily stored in a memory in control section 30. After the print image data is transferred to the printer section 11, yellow (Y), magenta (M), cyan (C) and black (K) recording laser lights corresponding to the print image data are generated by a laser recording section. Then, each of the recording laser lights are irradiated to a photoconductor 111 corresponding to each color to form an electrostatic latent image on the photoconductor. Sequentially, the electrostatic latent images are developed with the toner fed from a toner cartridge 112. The developed toner images are primarily transferred to an intermediate transfer belt 113. Then, the intermediate transfer belt 113 rotates clockwise to transfer the toner images to a paper fed from the paper tray 13 via the conveyance path 110 when the paper reaches a secondary transfer position 114.

The paper transferred with an image is pressurized and heated by a fixer 115 to fix the toner image. The paper is then conveyed through a paper discharging and conveying path. Then, the paper may be discharged to the first discharging tray 20 via the first paper discharge port 201 or the second discharging tray 22 via the second paper discharge port 221.

A rotatable flapper 116 is arranged at a position downstream of the fixer 115. The flapper 116 selectively changes the conveyance path of the printing object between a discharge path to the first paper discharge port 201 or the second paper discharge port 221 and a double-sided printing paper conveyance path 117 for reversing a printing object.

During double-sided printing, the flapper 116 is first positioned so that the paper is conveyed to the double-sided printing paper conveyance path 17 after the paper passes through the fixer 115. Then, the paper conveyance direction is reversed, and the paper is conveyed to be again fed to the secondary transfer position 114 via the double-sided printing paper conveyance path 117 to realize a double-sided printing operation.

Further, finisher functions (not shown) may be realized between the flapper 116 and the first paper discharge port 201. In the finisher functions, a post-processing is carried out on a printed paper according to the function designated by a user. Specifically, a staple or a punch unit is arranged to realize functions such as a staple function (bind at one or two positions), a punch function (punch two or three holes), or a bookbinding saddle stitching function.

The paper is then discharged to the first discharging tray 20 or the second discharging tray 22 corresponding to a copy function, a printer function, an FAX function or a sending function according to the setting from a user. The printer section 11, although described herein based on an example of a four-color-drum printer, may be a one-color-drum printer or a monochrome printer.

When the printer section is used as a printer, various settings on monochrome printing/color printing, paper size, double-sided printing, staple, punch, bookbinding saddle stitching, interleaving paper, front cover and back cover can be carried out by a driver.

Figure 2:
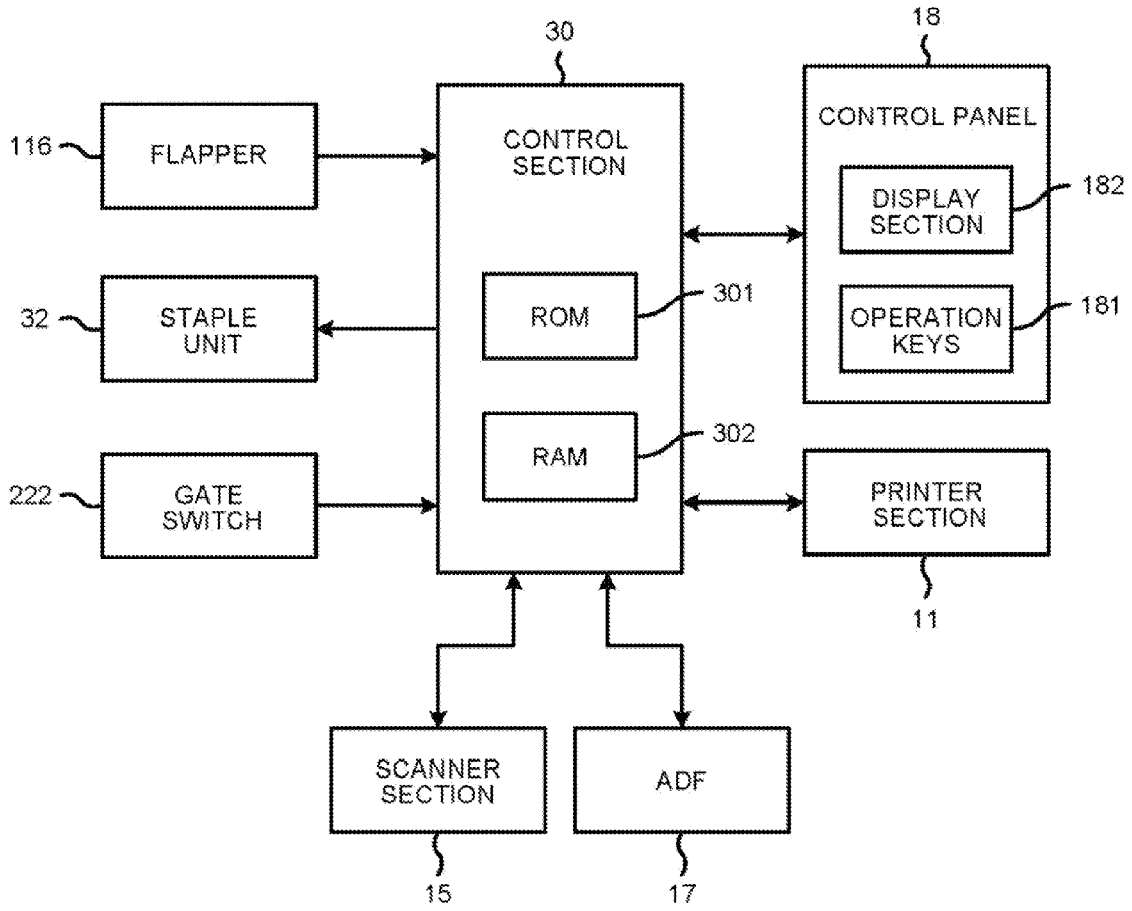
FIG. 2 is a block diagram illustrating a control system of the image forming apparatus.

FIG. 2 is a block diagram illustrating a control system for discharging a paper to the first discharging tray 20 or the second discharging tray 22 of the MFP 100.

In FIG. 2, a control section 30 includes a CPU, a ROM (Read Only Memory) 301 and a RAM (Random Access Memory) 302. The control section 30 controls the MFP 100 according to control program stored in the ROM 301. The control section 30 controls operations of the ADF 17, the scanner section 15 and the printer section 11 in response to the operation of the control panel 18. The RAM 302 temporarily stores the control data as needed for the operations.

The control panel 18, which includes a plurality of operations keys 181 and a display section 182 serving as a touch panel, provides various instructions for the formation of an image. For example, the operation keys 181 maybe operated to give an instruction on the number of copies. Similarly, the touch panel of the display section 182 may be operated to give instructions on paper size, paper type, staple, or folding.

Further, the control section 30 controls operations of the staple unit 32 and other finishers. For example, in addition to the staple unit 32, there are a punch unit and a cutter unit, which can also be controlled by the control section 30. Further, the control section 30 controls the flapper 116 in response to the double-sided printing operation indicated from the control panel 18. The control section 30 monitors the opening and closing state of a gate 223 based on the 'on'/'off' operation of the gate switch 222.

Control over staple unit 32 may include controlling the position of a stapler, implementation of the stapling by a stapler, conveyance of a paper to the stapler, and discharging of stapled paper bundle. Control over the punch unit 33 may include discharging of a paper punched with two or three holes.

Figure 3:
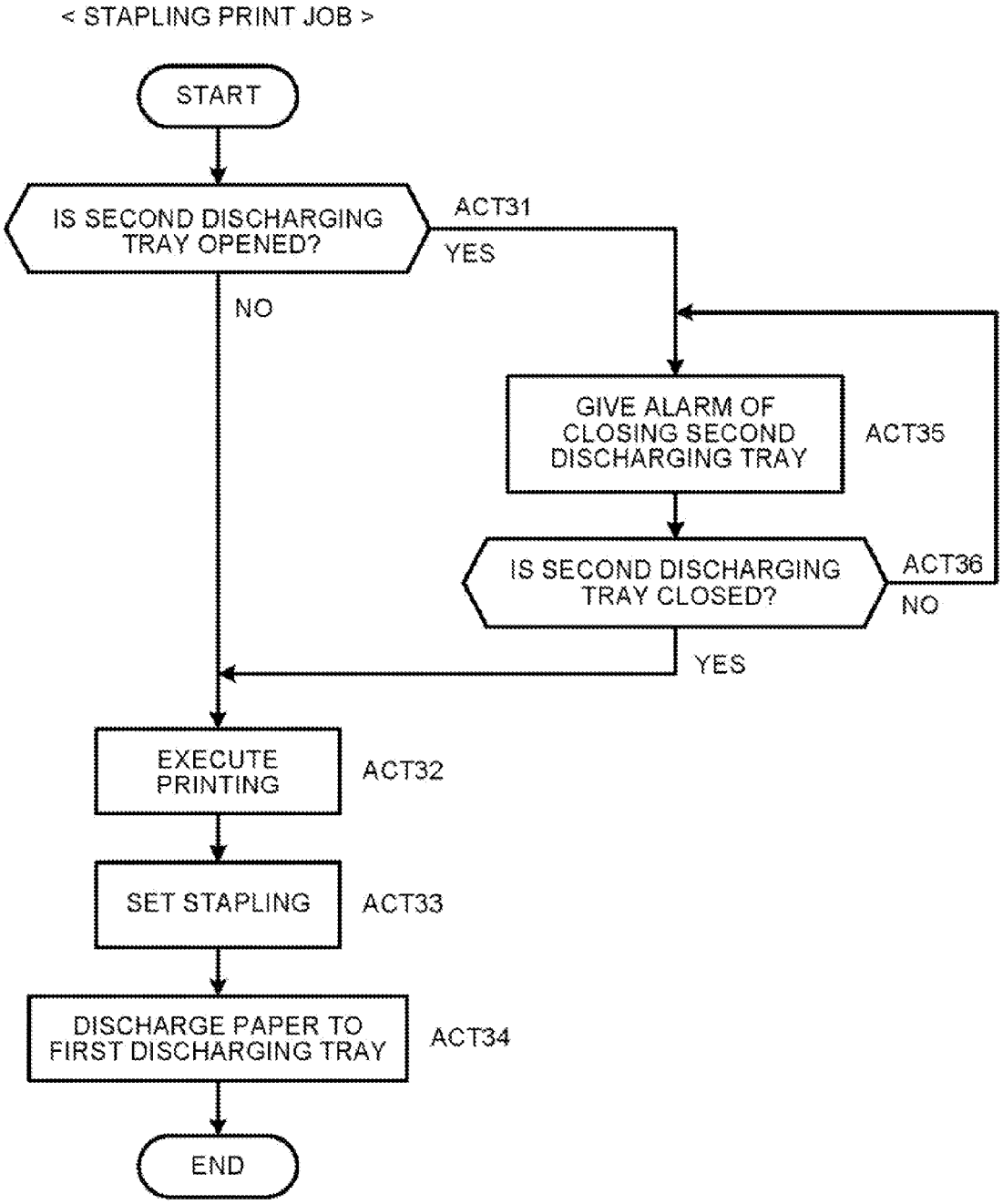
FIG. 3 is a flowchart illustrating a print job in a case where a stapling operation is set.

A print job in a case where a stapling operation is set is described below with reference to the flowchart in FIG. 3.

First, the operation keys 181 of the control panel 18 are operated to indicate the stapling operation. The control section 30 determines whether or not the second discharging tray 22 is opened based on the information of the gate switch 222 (ACT 31).

In ACT 31, if the control section 30 determines that the second discharging tray is closed (NO in ACT 31), the flow proceeds to ACT 32.

The control section 30 executes the printing (ACT 32), then performs stapling (ACT 33), and then discharges the stapled bundle to the first discharging tray 20 (ACT 34).

In ACT 31, if the control section 30 determines that the second discharging tray is opened (YES in ACT 31), the flow proceeds to ACT 35.

In ACT 35, the control section 30 gives an alarm indicating that the operator should close the second discharging tray 22. The alarm is given by displaying alarm information on the display section 182 of the control panel 18. The alarm can also be a voice alarm. Alarm information may be read by the control section 30 from the ROM 301.

After giving the alarm, the control section 30 determines whether or not the second discharging tray 22 is closed (ACT 36). If it is determined that the second discharging tray 22 is still not closed (NO in ACT 36), the flow proceeds to ACT 35 again. If it is determined that the second discharging tray 22 is closed (YES in ACT 36), the flow proceeds to ACT 32 to execute printing, and stapling in ACT 33. Then the paper is discharged to the first discharging tray 20 in ACT 34.

Figure 4:
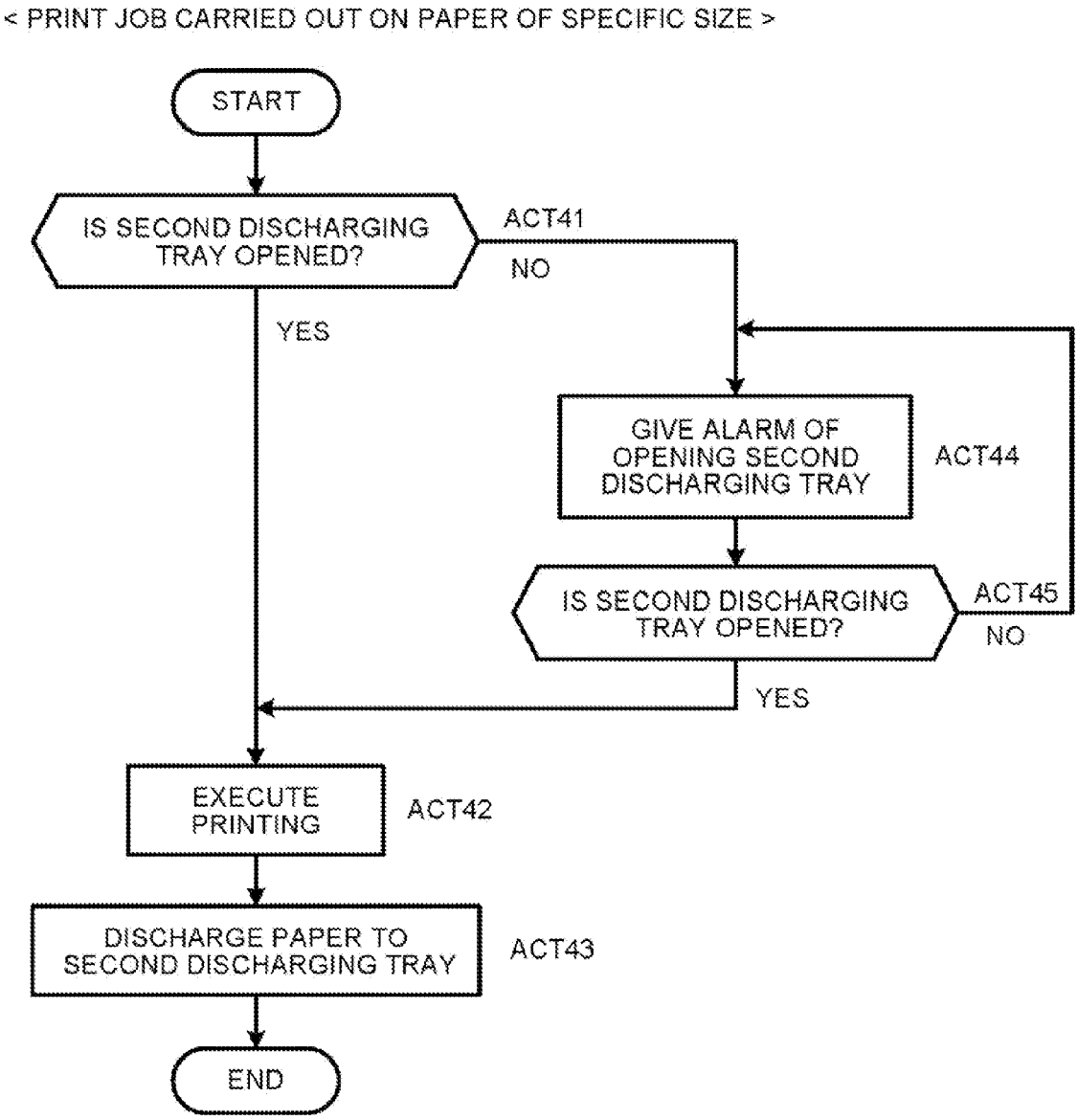
FIG. 4 is a flowchart illustrating a print job carried out on a paper of a specific size.

The printing job carried out on a paper of an unusual size is described below with reference to the flowchart in FIG. 4. The paper of an unusual size refers to a postcard or a paper having a size different than a common and/or standard size.

First, the operation keys 181 of the control panel 18 are operated to indicate printing on a paper of unusual size. The control section 30 determines whether or not the second discharging tray 22 is opened based on the information of the gate switch 222 (ACT 41).

In ACT 41, if the control section 30 determines that the second discharging tray is opened (YES in ACT 41), the flow proceeds to ACT 42.

The control section 30 then executes printing in ACT 42, and then discharges a printing object to the second discharging tray 22 (ACT 43).

If the control section 30 determines that the second discharging tray 22 is not opened (NO in ACT 41), the flow proceeds to ACT 44.

In ACT 44, the control section 30 gives an alarm indicating that the operator should open the second discharging tray 22 on the display section 182 of the control panel 18 for the operator.

After the alarm is ended, the control section 30 determines whether or not the second discharging tray 22 is opened (ACT 45). If it is determined that the second discharging tray 22 is again not opened (NO in ACT 45), the flow proceeds to ACT 44 again to give the alarm again. If it is determined that the second discharging tray 22 is opened (YES in ACT 45), the flow proceeds to ACT 42 to carry out printing on the specific paper and discharge the paper to the second discharging tray 22 in ACT 43.

Figure 5:
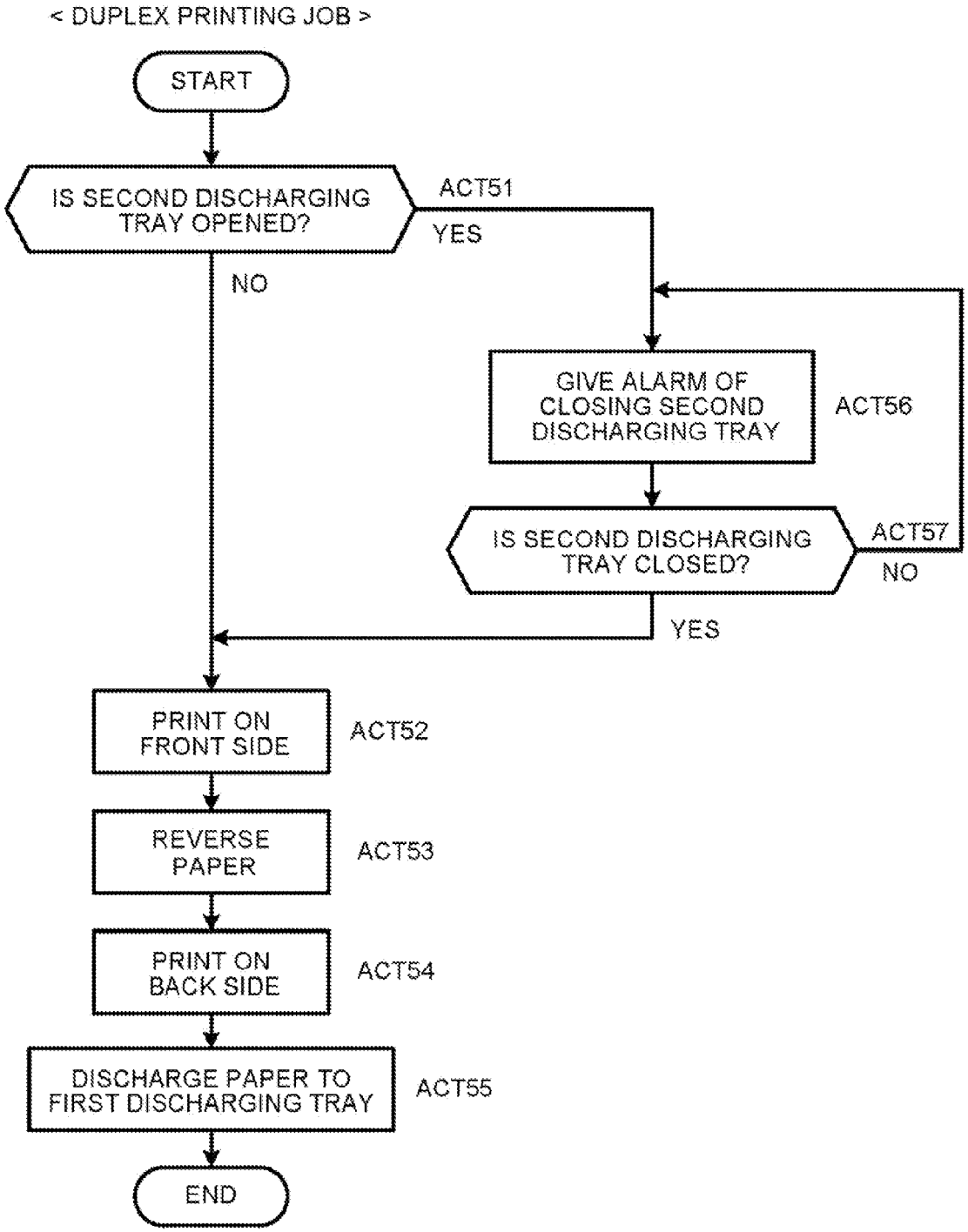
FIG. 5 is a flowchart illustrating a double-sided print job.

Sequentially, a double-sided printing job is described with reference to the flowchart in FIG. 5.

First, the operation keys 181 of the control panel 18 are operated to indicate double-sided printing. The control section 30 determines whether or not the second discharging tray 22 is opened based on the information of the gate switch 222 (ACT 51).

In ACT 51, if the control section 30 determines that the second discharging tray is closed (NO in ACT 51), the flow proceeds to ACT 52 to execute printing on a front side.

The control section 30 rotates the flapper 116 counterclockwise to convey the paper to the double-sided printing paper conveyance path 117 to reverse the paper (ACT 53). The control section 30 then carries out printing on back side of the paper (ACT 54).

The control section 30 then rotates the flapper 116 clockwise and discharges the paper that is printed on both sides to the first discharging tray 20 via the first discharge port 201 (ACT 55).

In ACT 51, if the control section 30 determines that the second discharging tray 22 is opened (YES in ACT 51), the flow proceeds to ACT 56.

In ACT 56, the control section 30 gives an alarm indicating that the operator should close the second discharging tray 22. The alarm is given by displaying alarm information on the display section 182 of the control panel 18.

After the alarm is ended, the control section 30 determines whether or not the second discharging tray 22 is closed (ACT 56). If it is determined that the second discharging tray 22 is not closed (NO in ACT 57), the flow proceeds to ACT 56 to again give the alarm. If it is determined that the second discharging tray 22 is closed (YES in ACT 57), the flow proceeds to ACT 52 to carry out a double-sided printing and then discharge the paper to the first discharging tray 20, as described above.

In this way, a print job that includes a stapling operation is interrupted to give an alarm indicating that the operator should close the second discharging tray 22 if the second discharging tray 22 is opened. A print job that includes printing on a paper of unusual size is interrupted to give an alarm indicating that the operator should open the second discharging tray 22 if the second discharging tray 22 is closed. A print job that includes double-sided printing is interrupted to give an alarm indicating that the operator should close the second discharging tray 22 if the second discharging tray 22 is opened.

The appropriate discharging tray corresponding to a print job including a stapling operation, a print job including printing on a paper of unusual size or a double-sided printing job can be selected in the embodiment.

In the embodiment, the alarm is displayed on the display section 182. However, it is not limited to this. The alarm may also be given as an audio alarm. In addition, the alarm can be displayed and given as an audio alarm as well.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a printer section configured to print image data to a paper according to a print job;

a control panel configured to receive instructions regarding the print job;

a first discharging tray configured to receive the printed paper;

a second discharging tray configured to be opened and closed, to receive the printed paper when opened, and guide the printed paper to the first discharging tray when closed;

a detection section configured to detect whether the second discharging tray is open or closed; and a control section configured to control execution of the print job including controlling the printer section and discharge of the printed paper to one of the first discharging tray and the second discharging tray, based on the instructions received in the control panel and the detection result of the detection section.

2. The image forming apparatus according to claim 1, further comprising:

a staple unit configured to perform a stapling operation on a print job, wherein if the instructions regarding the print job received in the control panel indicate the print job includes the stapling operation, and if the detection section detects that the second discharging tray is opened, the control section stops the print job and gives an alarm indicating a user should close the second discharging tray.

3. The image forming apparatus according to claim 2, wherein if the detection section detects that the second discharging tray is closed, the control section executes the print job including performing the stapling operation with the staple unit and discharges the printed paper to the first discharge tray.

4. The image forming apparatus according to claim 1, wherein if the instructions regarding the print job received in the control panel indicate the print job includes printing on a paper that has a size different from a predetermined standard size, and if the detection section detects that the second discharging tray is closed, the control section stops the print job and gives an alarm indicating a user should open the second discharging tray.

5. The image forming apparatus according to claim 4, wherein if the detection section detects that the second discharging tray is open, the control section executes the print job including printing on the paper that has the size different from the predetermined standard size and discharges the printed paper to the second discharge tray.

6. The image forming apparatus according to claim 1, further comprising:

a double-sided printing paper conveyance path configured to reverse a printing object for double-sided printing, wherein if the instructions regarding the print job received in the control panel indicate the print job includes double-sided printing, and if the detection section detects that the second discharging tray is opened, the control section stops the print job and gives an alarm indicating a user should close the second discharging tray.

7. The image forming apparatus according to claim 6, wherein if the detection section detects that the second discharging tray is closed, the control section executes the print job including performing the double-sided printing using the double-sided printing paper conveyance path, and discharges the printed paper to the first discharge tray.

8. The image forming apparatus according to claim 1, wherein the control panel comprises at least one of operation keys and a touch-screen display panel.

9. An image forming method, comprising:

receiving instructions regarding a print job including printing image data to a paper in a printer section;

discharging the printed paper to a first discharging tray or a second discharging tray, the second discharging tray movable between an open position for receiving the discharged paper and a closed position for guiding the paper to the first discharging tray;

detecting whether the second discharging tray is in the open or closed position; and controlling execution of the print job including controlling the printer section and discharge of the printed paper to one of the first discharging tray and the second discharging tray, based on the instructions received and whether the second discharging tray is detected in the open or closed position.

10. The method according to claim 9, wherein if the received instructions regarding the print job indicate the print job includes a stapling operation, and if the second discharging tray is detected in the open position, the print job is stopped and an alarm is provided indicating a user should close the second discharging tray.

11. The method according to claim 10, wherein if the second discharging tray is detected in the closed position, the print job including the stapling operation is executed and discharged to the first discharging tray.

12. The method according to claim 9, wherein if the received instructions regarding the print job indicate the print job includes printing on a paper that has a size different from a predetermined standard size, and if the second discharging tray is detected in the closed position, the print job is stopped and an alarm is provided indicating a user should open the second discharging tray.

13. The method according to claim 12, wherein if the second discharging tray is detected in the open position, the print job including printing on the paper that has the size different from the predetermined standard size is executed and discharged to the second discharging tray.

14. The method according to claim 9, wherein if the received instructions regarding the print job indicate the print job includes double-sided printing, and if the second discharging tray is detected in the open position, the print job is stopped and an alarm is provided indicating a user should close the second discharging tray.

15. The method according to claim 14, wherein if the second discharging tray is detected in the closed position, the print job including double-sided printing is executed and discharged to the first discharging tray.

16. A non-transitory computer-readable medium containing instructions for controlling an image forming apparatus comprising a printer section configured to print image data to a paper according to a print job, a control panel configured to receive instructions regarding the print job, a first discharging tray configured to receive the printed paper, and an second discharging tray movable between an open position for receiving the discharged paper and a closed position for guiding the paper to the first discharging tray, the instructions causing a control section to:

detect whether the second discharging tray is in the open or closed position; and control execution of the print job including controlling the printer section and discharge the printed paper to one of the first discharging tray and the second discharging tray, based on the instructions received and whether the second discharging tray is detected in the open or closed position.

17. The non-transitory computer-readable medium according to claim 16, wherein if the received instructions regarding the print job indicate the print job includes one of a stapling operation or a double-sided printing, and if the second discharging tray is detected in the open position, the instructions further cause the control section to stop the print job and provide an alarm indicating a user should close the second discharging tray.

18. The non-transitory computer-readable medium according to claim 17, wherein if the second discharging tray is detected in the closed position, the instructions further cause the control section to execute the print job including the stapling operation or the double-sided printing and discharge the printed paper to the first discharging tray.

19. The non-transitory computer-readable medium according to claim 16, wherein if the received instructions regarding the print job indicate the print job includes printing on a paper that has a size different from a predetermined standard size, and if the second discharging tray is detected in the closed position, the instructions further cause the control section to stop the print job and provide an alarm indicating a user should open the second discharging tray.

20. The non-transitory computer-readable medium according to claim 19, wherein if the second discharging tray is detected in the open position, the instructions further cause the control section to execute the print job including printing on the paper that has the size different from the predetermined standard size.

* * * * *